US006367995B1

(12) United States Patent
Hashimoto et al.

(10) Patent No.: US 6,367,995 B1
(45) Date of Patent: Apr. 9, 2002

(54) TAPE PRINTER

(75) Inventors: Akira Hashimoto, Shiojiri; Yoshikiyo Furuya, Matsumoto, both of (JP)

(73) Assignees: Seiko Epson Corporation; King Jim Co., Ltd., both of Tokyo (JP)

( * ) Notice: Subject to any disclaimer, the term of this patent is extended or adjusted under 35 U.S.C. 154(b) by 0 days.

(21) Appl. No.: 09/601,011

(22) PCT Filed: Nov. 25, 1999

(86) PCT No.: PCT/JP99/06573

§ 371 Date: Jul. 25, 2000

§ 102(e) Date: Jul. 25, 2000

(87) PCT Pub. No.: WO00/32402

PCT Pub. Date: Jun. 8, 2000

(30) Foreign Application Priority Data

Nov. 27, 1998 (JP) ..... 10-337555

(51) Int. Cl.[7] ..... B41J 35/28

(52) U.S. Cl. ..... 400/207; 400/208; 400/242; 400/611; 400/613; 400/615.2

(58) Field of Search ..... 400/615.2, 621, 400/613, 611, 242, 207, 208, 691–693.1

(56) References Cited

U.S. PATENT DOCUMENTS 5,597,247 A * 1/1997 Inakoshi et al. ..... 400/207
5,921,688 A * 7/1999 Furuya et al. ..... 400/207
6,145,561 A * 11/2000 Watanabe et al. ..... 400/621 X

FOREIGN PATENT DOCUMENTS

| | | |
|---|---|---|
| EP | 745487 A1 | 12/1996 |
| JP | 51-114013 | 10/1976 |
| JP | 51-155620 | 12/1976 |
| JP | 3-175079 | 7/1991 |

* cited by examiner

*Primary Examiner*—John S. Hilten
*Assistant Examiner*—Minh H. Chau
(74) *Attorney, Agent, or Firm*—Hogan & Hartson, L.L.P.

(57) ABSTRACT

There is provided a tape printing apparatus in which a cartridge-ejecting function by an ejection mechanism and a cartridge-holding function by a cartridge compartment are separated from each other based on a simple construction. In the tape printing apparatus including a cartridge compartment for removably mounting a tape cartridge therein, and an ejection mechanism for lifting the tape cartridge mounted, from the cartridge compartment, the cartridge compartment has a bottom thereof formed with a seat portion for seating thereon the tape cartridge in a mounted state, and a lift plate of the ejection mechanism for lifting a tape cartridge is positioned away from the tape cartridge seated on the seat portion when the lift plate is in a standby state. This construction makes it possible to separate the cartridge-ejecting function implemented by the ejection mechanism and the cartridge-holding function by the cartridge compartment from each other, thereby preventing the ejection mechanism from adversely affecting printing operation.

6 Claims, 10 Drawing Sheets

TAPE PRINTER

TECHNICAL FIELD

This invention relates to a tape printing apparatus including an ejection mechanism for lifting a mounted tape cartridge from a cartridge compartment.

BACKGROUND ART

A tape printing apparatus including a conventional ejection mechanism has been proposed e.g. in Japanese Laid-Open Patent Publication (Kokai) No. 9-277678. The ejection mechanism is comprised of an ejection plate (lift plate) for supporting a tape cartridge in a cartridge compartment, an X-shaped link for lifting and lowering the ejection plate, and a spring for causing the X-shaped link to operate.

In the apparatus, when a lid-opening button is depressed, a lid of the cartridge compartment is caused to pop up to be half opened. Then, when the lid is manually fully opened from this state by the user, the ejection mechanism is unlocked, and the urging force of the spring causes the X-shaped link to operate to lift the ejection plate, whereby the tape cartridge is lifted from the cartridge compartment.

Reversely, when a tape cartridge is placed on the lifted ejection plate and pushed deep into the cartridge compartment, the ejection plate is lowered against the urging force of the spring and eventually locked, whereby the tape cartridge is properly mounted in the cartridge compartment.

In the conventional tape printing apparatus, the ejection plate is at its uppermost position when a tape cartridge has been removed, so that when a tape cartridge is mounted, it is required to push the tape cartridge deep into the cartridge compartment together with the ejection plate, which makes the operation troublesome. Further, if the lid is closed erroneously when the ejection plate is at its uppermost position, an inconvenience can occur that the lid is disassembled from the apparatus.

Further, while the ejection plate supports a tape cartridge thereon for printing when it is at its lowermost position, the X-shaped link supports the ejection plate. This tends to make the supported tape cartridge unstable as to a level state (levelness) and shaky due to the structure of the ejection mechanism, which makes it difficult to print accurately on a printing tape.

It is an object of the invention to provide a tape printing apparatus in which a cartridge-ejecting function by an ejection mechanism and a cartridge-holding function by a cartridge compartment are separated from each other based on a simple construction.

DISCLOSURE OF INVENTION

According to claim 1 of the invention, a tape printing apparatus including a cartridge compartment for removably mounting a tape cartridge therein, and an ejection mechanism for lifting the tape cartridge mounted, from the cartridge compartment is characterized in that the cartridge compartment has a bottom thereof formed with a seat portion for seating thereon the tape cartridge in a mounted state, and a lift plate of the ejection mechanism for lifting a tape cartridge is positioned away from the tape cartridge seated on the seat portion when the lift plate is in a standby state.

According to this construction, the lift plate of the ejection mechanism is positioned away from a tape cartridge seated on the seat portion when it is in a standby state. Therefore, the tape cartridge is used for printing in a state seated on the seat portion, and the lift plate receives the tape cartridge from the seat portion as it moves upward, to lift the same from the cartridge compartment. The seat portion is fixedly arranged, so that the tape cartridge seated on the seat portion is stably and accurately positioned for printing.

Preferably, the cartridge compartment has a support member arranged therein for holding the tape cartridge in a lifted state, and the lift plate immediately returns to its standby state after having been lifted to transfer the tape cartridge to the support member.

According to this construction, since the lift plate immediately returns to its standby state after having lifted a tape cartridge, a new tape cartridge can be loaded without any consideration of the lift plate. Further, since the lifted cartridge is transferred to the support member, it is possible to hold the tape cartridge in the lifted state even after the lift plate has returned to its standby state.

Preferably, the support member also serves as a holding nail for immovably holding the tape cartridge.

According to this construction, it is possible to use the holding nail serving as a support member, not only to immovably hold a tape cartridge on the seat portion, but also to hold a lifted tape cartridge in the lifted state. Further, since the holding nail also serves as a support member, an increase in number of component parts is prevented.

Preferably, the seat portion is formed by three seat members arranged separately from each other.

According to this construction, the three-point support by the three seat members makes it possible to hold a tape cartridge on the seat portion in a stable state without making the same shaky.

Preferably, the ejection mechanism comprises a lift plate for lifting a tape cartridge, link means for causing translation of the lift plate such that the lift plate can be lifted and lowered, and a motor for operating the link means.

According to this construction, the ejection mechanism can be operated automatically. Therefore, the ejection mechanism is not required to be interlocked with the lid of the cartridge compartment, or the like, which makes it possible to drive the ejection mechanism only when required.

BEST MODE OF CARRYING OUT THE INVENTION

The invention will now be described in detail with reference to the drawings showing a tape printing apparatus according to an embodiment thereof. The tape printing apparatus is capable of printing desired characters and figures on a strip of printing tape and cutting off a printed portion of the printing tape. The cut-off piece of the printing tape is used as a label to be affixed to a document file or the like. That is, the tape printing apparatus makes a label printed with characters and figures from a strip of plain printing tape. In this case, the plain printing tape and an ink ribbon as consumable articles are contained in a tape cartridge, and supplied to the apparatus via the tape cartridge.

Figure 1:
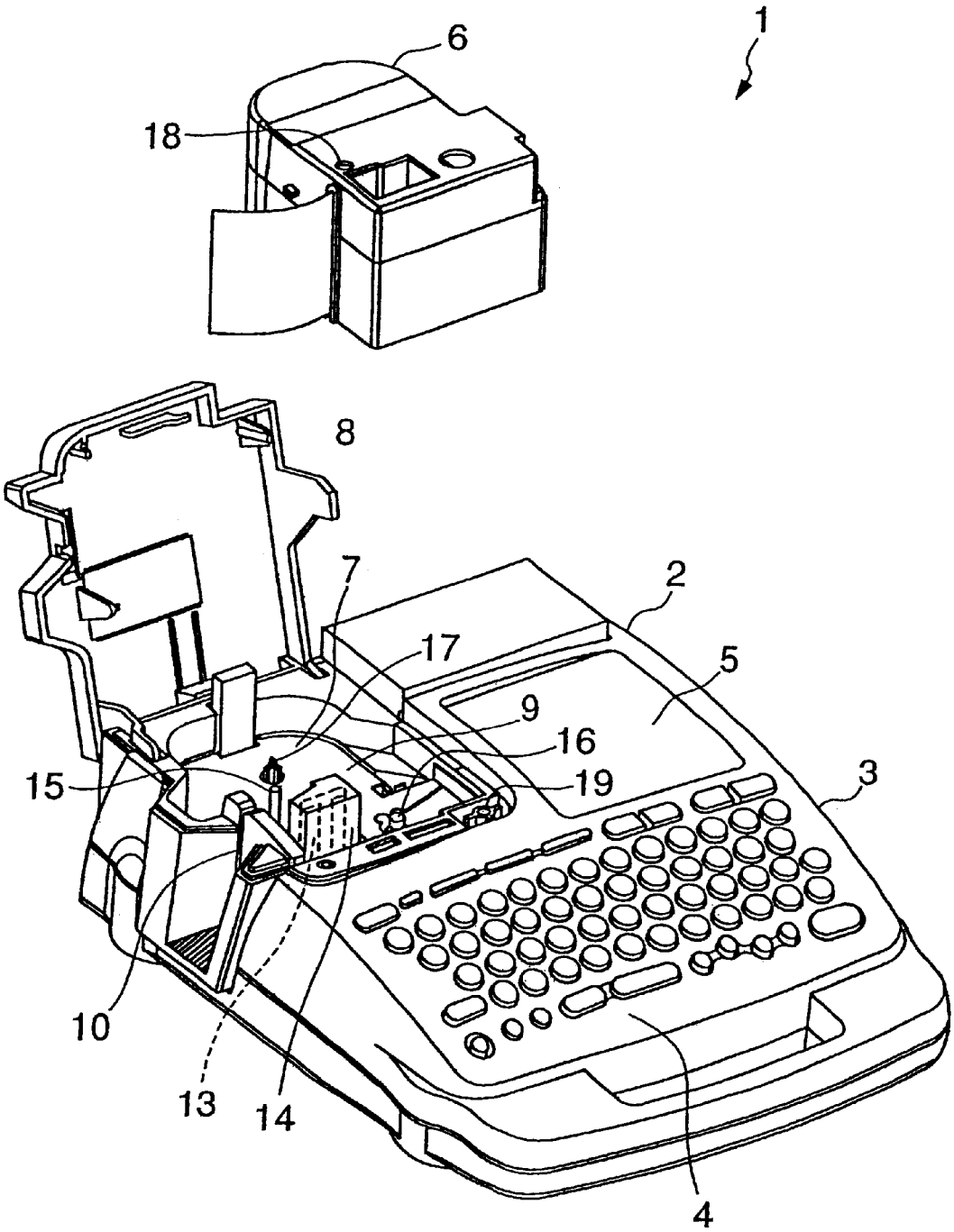
FIG. 1 is a perspective view of an appearance of a tape printing apparatus according to an embodiment of the invention.

Referring first to FIG. 1, the tape printing apparatus 1 has a body 2 having an apparatus casing 3 comprised of upper and lower divisional portions. The apparatus casing 3 has a key entry block 4 arranged in the front portion thereof, a liquid crystal display 5 arranged in the rear right-hand portion thereof, and a cartridge compartment 7 formed in the rear left-hand portion thereof, for mounting a tape cartridge 6 therein. The cartridge compartment 7 has a lid 8 formed with a window, the lid 8 being attached to the body 2 in a manner such that the lid 8 can be opened and closed. Further, incorporated in the cartridge compartment 7 is an ejection mechanism 9, described in detail hereinafter, for lifting the received tape cartridge 6 up to a position allowing the same to be easily taken out.

Figure 4:
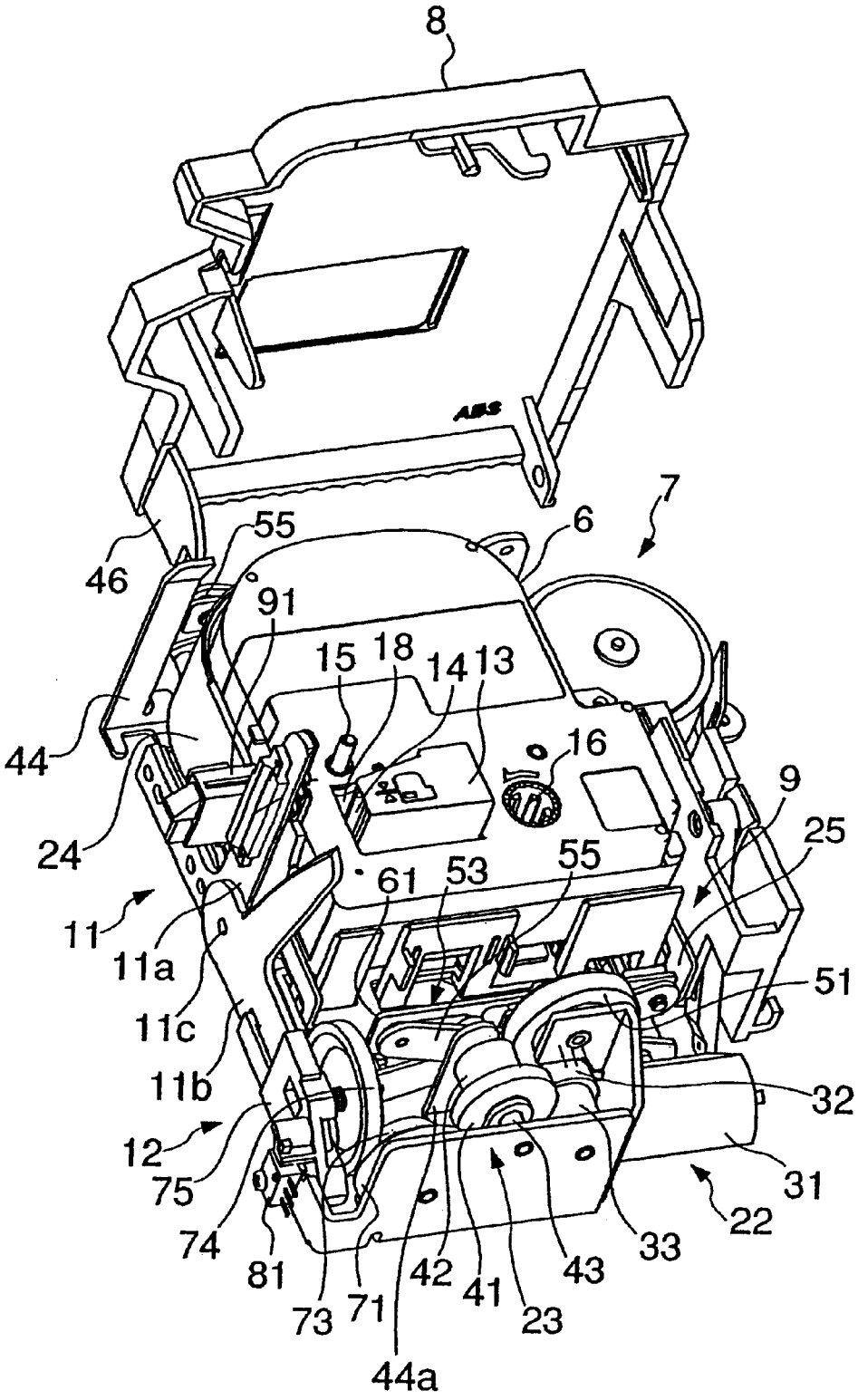
FIG. 4 is a perspective view of the cartridge compartment (ejection mechanism) of the tape printing apparatus and component parts associated with the cartridge compartment.

The apparatus casing 3 has a left side portion thereof formed with a tape exit 10 for permitting the cartridge compartment 7 and the outside of the apparatus 1 to communicate with each other, and a tape cutter 11 for cutting off a dispensed portion of the printing tape faces the tape exit 10 (see FIG. 4). The tape cutter 11 is linked to an automatic cutting mechanism 12, and operated by the automatic cutting mechanism to perform cutting operation. As described in detail hereinafter, the automatic cutting mechanism 12 and the ejection mechanism 9 are driven for operation by an identical drive source.

Figure 3:
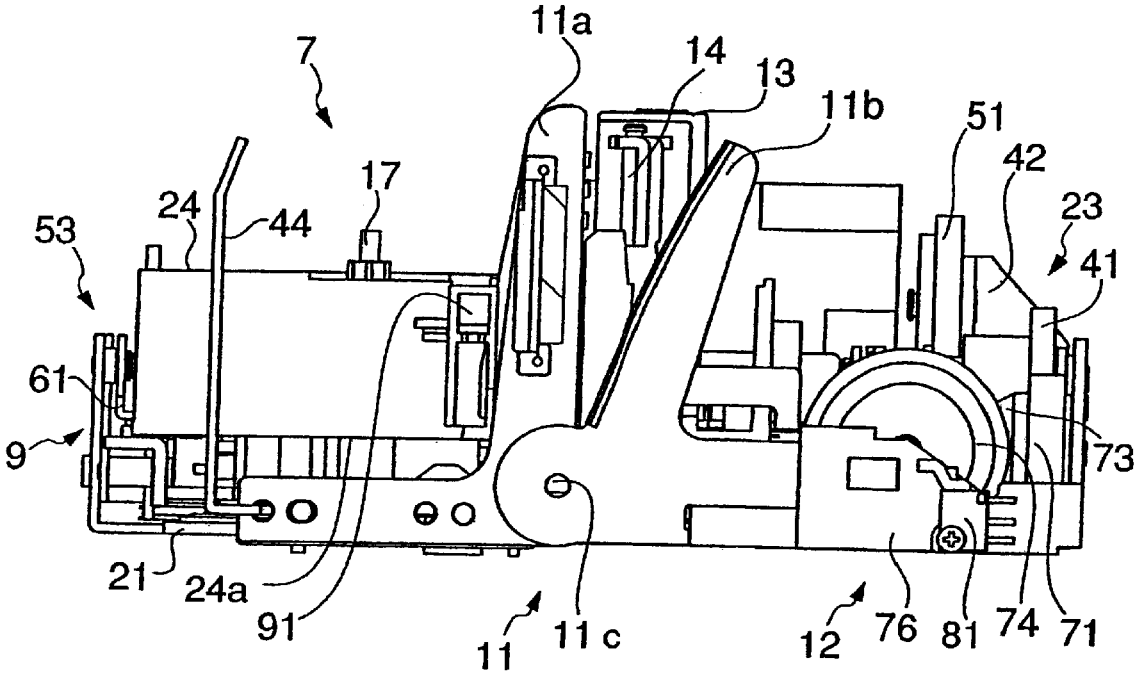
FIG. 3 is a side view of the cartridge compartment (ejection mechanism) of the tape printing apparatus and component parts associated with the cartridge compartment.

In the cartridge compartment 7, there extend upright a print head 14 covered with a head cover 13, a platen shaft 15 opposed to the print head 14, a take-up reel 16 for taking up used part of the ink ribbon, and a guide projection 17 (see FIG. 3) for guiding the tape cartridge 6 when it is mounted. A platen 18 is arranged in the tape cartridge 6 (see FIGS. 1 and 4). Further, installed under the cartridge compartment 7 is a tape feed mechanism (not shown) for causing rotation of the platen 18 and the take-up reel 16.

When a label is produced by using the tape printing apparatus 1, first, a lid-opening button 19 located near a corner of the lid 8 is depressed to cause the lid 8 to pop up, and then the lid 8 is manually fully opened. Then, the tape cartridge 6 is pushed into the cartridge compartment 7 from above for mounting. When the tape cartridge 6 is mounted, the lid 8 is closed to place the tape printing apparatus 1 in a printing wait state. Then, input is carried out as desired by operating the key entry block 4 while viewing the liquid crystal display 5. When the desired input can be confirmed on the liquid crystal display 5, the key entry block 4 is further operated to issue a print command.

When the print command is issued, the printing tape and the ink ribbon contained in the tape cartridge 6 start to run simultaneously, and printing is carried out on the printing tape as desired by the print head 14. As the printing operation proceeds, a used portion of the ink ribbon is taken up in the tape cartridge 6, while a printed portion of the printing tape is sent out of the apparatus via the tape exit 10. When the printing is completed, the printing tape is further fed by an amount corresponding to a margin, and then the running of the printing tape and the ink ribbon is stopped. Subsequently, the automatic cutting mechanism 12 operates to cause cutting operation of the tape cutter 11, whereby the printed portion of the printing tape is cut off.

On the other hand, to take out the cartridge 6, the lid-opening button 19 is depressed to cause the lid 8 to pop up, and then the lid 8 is manually fully opened. In this state, the ejection mechanism 9 is started by key operation for being driven. When the ejection mechanism 9 is driven, the tape cartridge 6 is lifted to the position allowing the same to be taken up easily.

Figure 2:
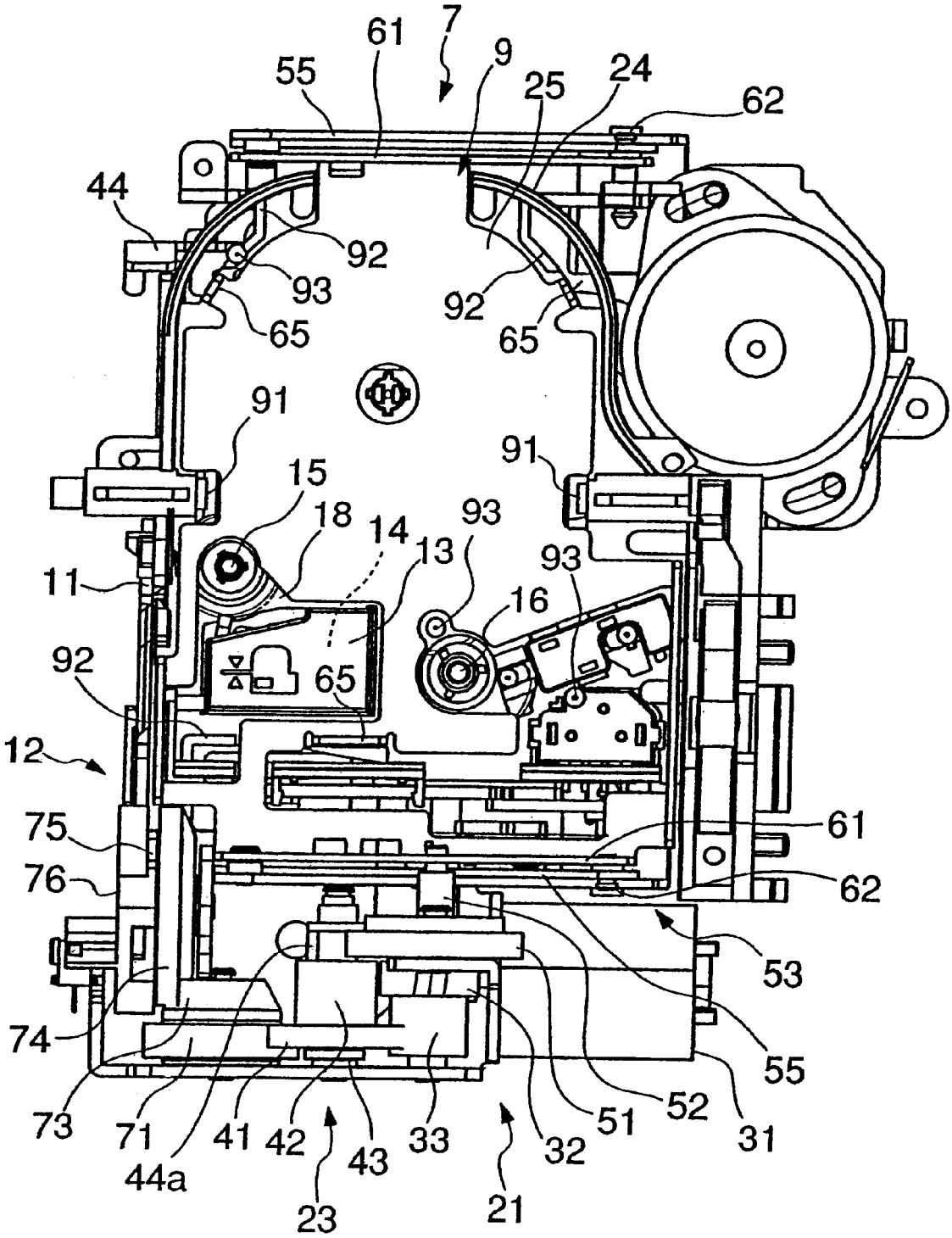
FIG. 2 is a plan view of a cartridge compartment (ejection mechanism) of the tape printing apparatus and component parts associated with the cartridge compartment.

Next, the ejection mechanism 9 and the automatic cutting mechanism 12, which are operated by the single drive source, will be described in detail with reference to FIGS. 2 and 7. These figures show the cartridge compartment 7 and component parts associated with the cartridge compartment 7 with the apparatus casing 3 being removed therefrom. A driving block 22 is comprised of a motor 31 fixed to a base frame 21 and serving as the single drive source, and a gear train linked to a main shaft of the motor 31. One of the ejection mechanism 9 and the automatic cutting mechanism 12 is selectively operated by the driving block 22 via a clutch mechanism 23. In this embodiment, on the base frame 21 from which the print head 14 extends upright, there is arranged a compartment casing 24 defining the cartridge compartment 7, in a manner sandwiching a tape feed mechanism (not shown) between the base frame 21 and the compartment casing 24 itself. Arranged on a bottom plate 24*a* of the compartment casing 24 is an election plate 25, described in detail hereinbelow (see FIGS. 5 and 6).

As shown in FIGS. 2, 3, 4, and 7, the clutch mechanism 23 is operated in a manner interlocked with the opening/closing operation of the lid 8. The clutch mechanism 23 transmits torque of the motor 31 to the ejection mechanism 9 when the lid 8 is in its "open" state, and transmits the same to the automatic cutting mechanism 12 when the lid 8 is in its "closed" state. The output end of ejection mechanism 9 is an ejection plate 25 serving as a lift plate. When the ejection mechanism 9 is operated, the ejection plate 25 is caused to move upward to lift the tape cartridge 6 mounted in the cartridge compartment 7. On the other hand, the output end of the automatic cutting mechanism 12 is connected to the scissors-like tape cutter 11 comprised of a stationary blade 11*a* and a movable blade 11*b*. When the automatic cutting mechanism 12 is operated, the tape cutter 11 performs cutting operation for cutting a portion of the printing tape which has been brought to the tape cutter 11.

The driving block 22 includes a worm (not shown) rigidly fitted on the main shaft of the motor 31, a worm wheel 32 mating with the worm, and a gear 33 having a large width and coaxially fixed to the worm wheel 32. The torque of the motor 31 is transmitted through the worm and worm wheel 32 and the gear 33 to the clutch mechanism 23.

The clutch mechanism 23 is comprised of a first transmission gear 41 mating with the gear 33, a second transmission gear 42 fixed to the first transmission gear 41, a clutch shaft 43 rotatably supporting the first transmission gear 41 and the second transmission gear 42, and a clutch arm 44 having a nail 44*a* for causing the first transmission gear 41 and the second transmission gear 42 to axially slide along the clutch shaft 43. The clutch arm 44 is supported on the base frame 21 in a state urged by a coiled spring 45 such that the clutch arm 44 can advance and withdraw. The clutch arm 44 has a trailing end thereof extending to a root portion of the lid 8 (see FIG. 7).

In association with the clutch arm 44, a cam piece 46 extends downward perpendicularly from the root portion of the lid 8. When the lid 8 is closed, cam action of the cam piece 46 allows the clutch arm 44 to withdraw by the urging force of the coiled spring 45 to thereby cause the first transmission gear 41 and the second transmission gear 42 to slide backward, whereby the first transmission gear 41 is disengaged from a cutter-side input gear (referred to hereinafter) 71 while the second transmission gear 42 is caused to mate with the ejection mechanism-side input gear (referred to hereinafter) 51. Inversely, when the lid 8 is opened, the cam action of the cam piece 46 causes the clutch arm 44 to advance against the urging force of the coiled spring 45 to cause the first transmission gear 41 and the second transmission gear 42 to slide in an opposite direction, whereby the first transmission gear 41 is caused to mate with the cutter-side input gear 71 while the second transmission gear 42 is disengaged from the ejection mechanism-side input gear 51 (see FIG. 4).

The ejection mechanism 9 is comprised of the ejection mechanism-side input gear 51 mating with the second transmission gear 42 of the clutch mechanism 23, a crankpin 52 projecting from an end face of the ejection mechanism-side input gear 51, the ejection plate 25 for engagement with the crankpin 52, and link means 53 for causing translation of the ejection plate 25. It should be noted that an ejection mechanism recited in CLAIMS includes the motor 31 in addition to the ejection mechanism 9 described above.

Figure 5:
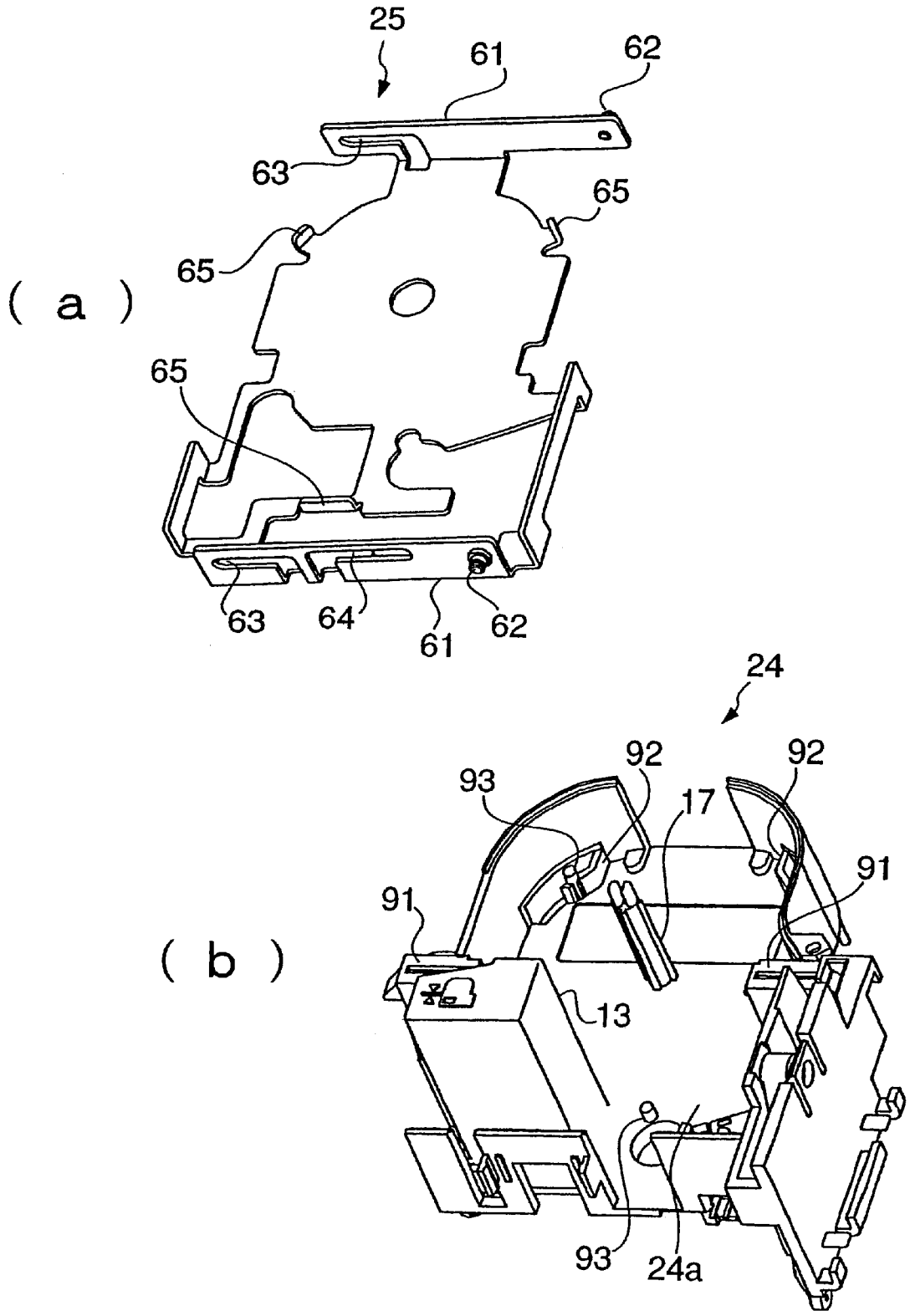
FIG. 5 is a perspective view of an ejection plate and a compartment casing.
Figure 6:
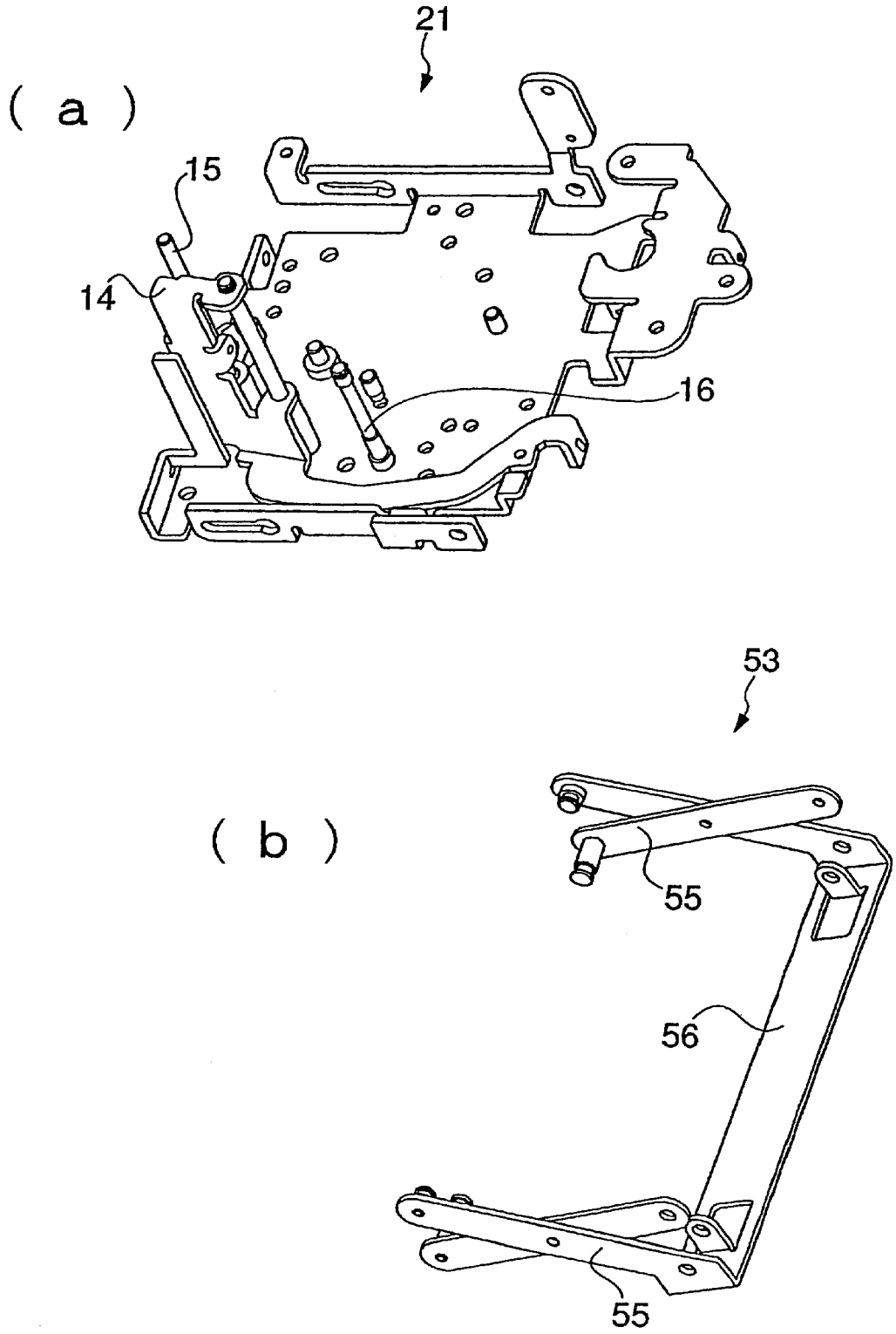
FIG. 6 is a perspective view of a base frame and link means.
Figure 7:
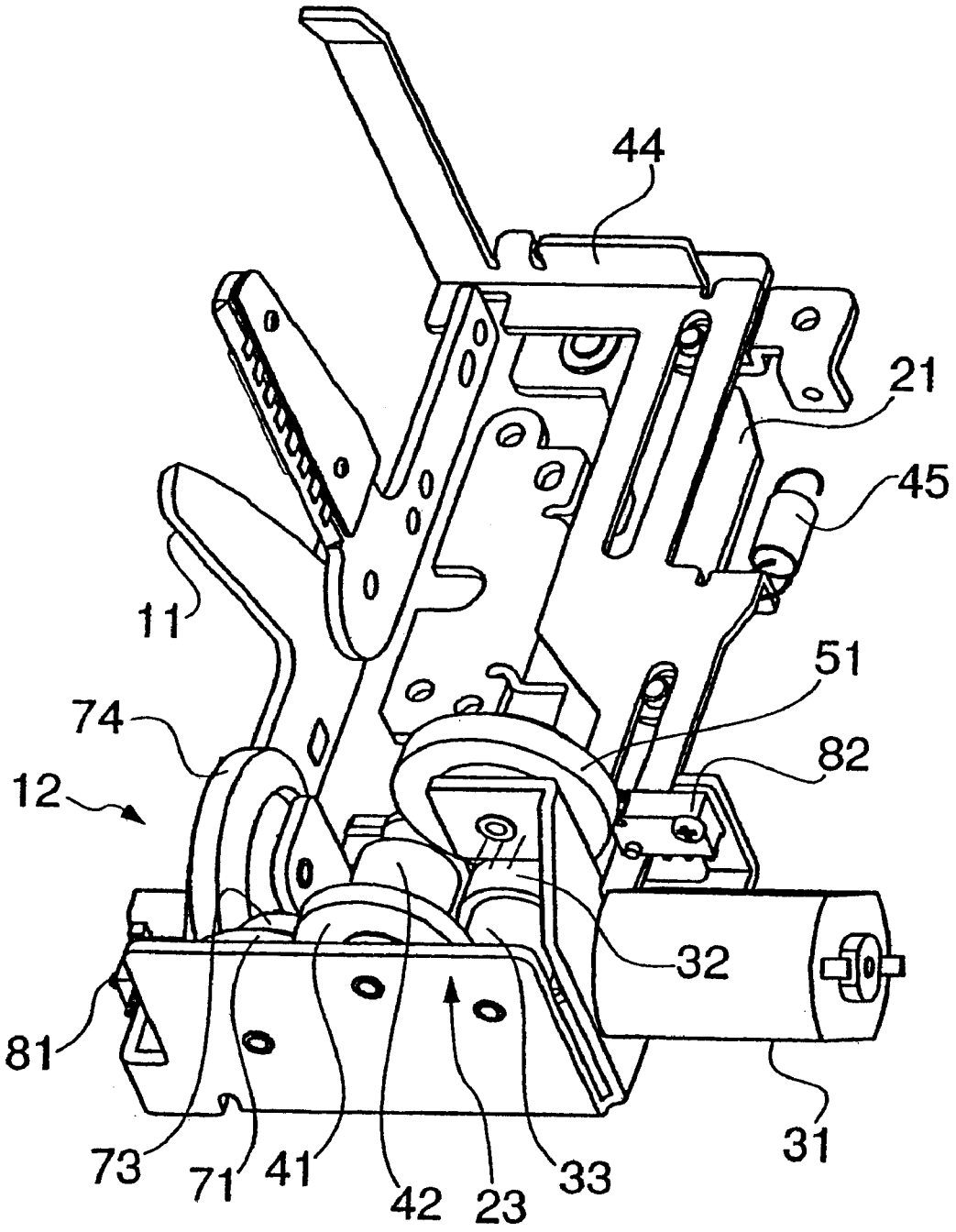
FIG. 7 is a perspective view of an automatic cutting mechanism and component parts associated therewith.

As shown in FIG. 6, the link means 53 is comprised of a pair of front and rear X-shaped links 55, 55, and a connecting arm 56 for connecting between the pair of X-shaped links 55, 55, and supported on the base frame 21 by the connecting arm 56. The pair of X-shaped links 55, 55 are not only supported on the base frame 21 but also engaged with the ejection plate 25. More specifically, each of the X-shaped links 55 has two end portions at one of left and right sides thereof pivotally attached to the base frame 21 and the ejection plate 25, respectively, and two end portions of at the other of left and right sides thereof attached to the base frame 21 and the ejection plate 25, respectively, in a pivotally movable and laterally slidable manner (see FIGS. 5 and 6). This allows the ejection plate 25 to perform vertical translation (i.e. to be moved vertically) with respect to the base frame 21.

As shown in FIG. 5, the ejection plate 25, which is in the form of a plate, is formed with openings and cutouts for avoiding interference with the head cover 13, the take-up reel 16, and so forth. Further, the ejection plate 25 has front and rear upright edges 61, 61 formed by bending front and rear portions of the ejection plate 25 upward for having the X-shaped links 55 attached thereto, respectively. The upright edges 61 are each formed with a pin 62 and a slot 63 on and in which the X-shaped link 55 are attached. Further, the front side one of the upright edges 61 has a mid portion thereof formed with a crank slot 64 in which the crankpin 52 projecting from the ejection mechanism-side input gear 51 is engaged.

That is, the crankpin 52 and the crank slot 64 form a crank mechanism. Rotation of the ejection mechanism-side input gear 51 causes vertical movement of the ejection plate 25 via the crankpin 52 and the crank slot 64, and at the same time, the translation of the X-shaped links 55 causes the ejection plate 25 to move vertically while maintaining its level orientation. Reference numerals 65 in FIG. 5 designate three projections formed on the ejection plate. When a thinner tape cartridge 6 is ejected, it is placed on the projections 65, while when a thicker tape cartridge 6 is ejected, the projections 65 are fitted in grooves formed on an underside surface of the tape cartridge 6 and the underside surface is held in contact with a flat portion of the ejection plate 25 (there are provided tape cartridges (printing tapes) 6 which are different in thickness or tape width from each other).

On the other hand, the automatic cutting mechanism 12 is comprised of the cutter-side input gear 71 mating with the first transmission gear 41 of the clutch mechanism 23, an input bevel gear 73 coaxially fixed to the cutter-side input gear 71, an output bevel gear 74 mating with the input bevel gear 73, and a crankpin 75 (see FIG. 2) projecting from an end face of the output bevel gear 74. The crankpin 75 is engaged with a holder 76 fixed to the movable blade 11*b* of the tape cutter 11. That is, the crankpin 75 is fitted in a slot (not shown) formed in the holder 76, thereby forming a crank mechanism with the slot. Accordingly, when the cutter-side input gear 71 rotates, the torque is transmitted to an intermediate gear 72, the input bevel gear 73, and the output bevel gear 74, and the rotation of the output bevel gear 74 causes cutting operation (pivotal motion) of the movable blade 11*b* about a support shaft 11*c* via the holder 76.

As described above, when the motor 31 is started for rotation (by key operation) in a "closed" state of the lid 8, the torque of the motor 31 is transmitted to the tape cutter 11 via the automatic cutting mechanism 12 and causes the tape cutter 11 to perform the cutting operation. On the other hand, when the motor 31 is started for rotation (by key operation) in an "open" state of the lid 8, the torque of the motor 31 causes the ejection mechanism 9 to elevate the ejection plate 25, whereby the tape cartridge 6 is lifted from the cartridge compartment 7. It should be noted that the cutting operation of the tape cutter 11 is performed by pivotal reciprocating motion of the movable blade 11*b* from its standby position and that the upward moving operation of the ejection plate 25 is performed by vertical reciprocating motion of the ejection plate 25 to and from its standby position which is lower than the location of the bottom plate 24*a* of the compartment casing 24. Therefore, when the movable blade 11*b* and the ejection plate 25 are at their respective stop positions (standby positions), they are detected by micro switches 81, 82, respectively, so as to stop the motor 31 (see FIGS. 4 and 7).

Now, the relationship between the operation of the ejection plate 25 from its standby position and the compartment casing 24 will be described in detail with reference to FIGS. 5 and 8. As shown in FIG. 5, the compartment casing 24 has an inside thereof formed to have a generally complementary shape to the tape cartridge 6, and on the bottom plate 24*a* are erected the head cover 13 and the guide projection 17 integrally formed with the bottom plate 24*a*. Further, a pair of holding nails 91, 91 are arranged on respective opposite sides of the bottom plate 24*a* in a manner each facing inward (see FIG. 2). When the tape cartridge 6 is mounted, the pair of holding nails 91, 91 sandwich the tape cartridge 6 therebetween and press down the same, whereby the tape cartridge 6 mounted in the compartment casing (cartridge compartment 7) 24 is held in an immovable state.

Further, three seat projections (seat members) 92, 92, 92 are integrally formed with the compartment casing 24 at respective locations therein, for allowing the tape cartridge 6 mounted in the compartment casing 24 (see FIG. 2) to be seated thereat. More specifically, the tape cartridge 6 mounted in the compartment casing 24 is held in an immovable state by being sandwiched by the pair of holding nails 91, 91 and pressed against the seat projections 92 by the same. On the other hand, when the tape cartridge 6 is lifted from the compartment casing 24, it is placed on the upper ends of the pair of holding nails 91, 91 and held in the lifted state even after the ejection plate 25 is lowered.

Now, the relationship between the pair of holding nails 91, 91 and the tape cartridge 6 for being lifted and lowered will be described with reference to FIGS. 9 and 10. As shown in these figures, each of the holding nails 91 is mounted on a side of the compartment casing 24. The holding nail 91 is comprised of a nail element 101, an urging member 102, and a coiled spring 103 interposed between the nail element 101 and the urging member 102. The nail element 101 is attached to the compartment casing 24 such that it can advance and withdraw, and a forward end 101*a* of the nail element 101 projects into the compartment casing 24 by the urging force of the coiled spring 103 and retracts therefrom.

Figure 9:
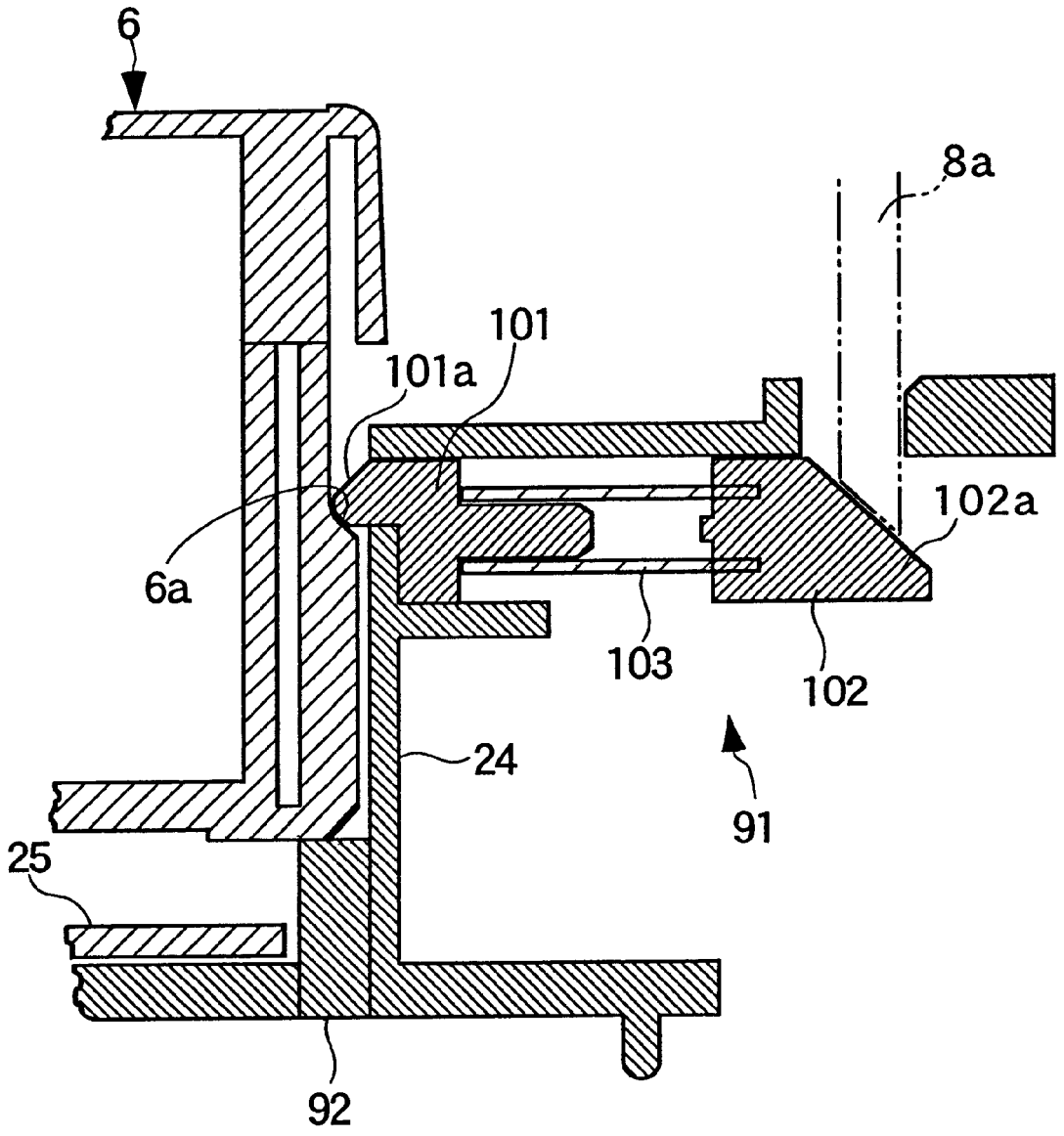
FIG. 9 is an enlarged sectional view of a holding nail and component parts associated therewith, in a state of a tape cartridge being completely mounted.
Figure 10:
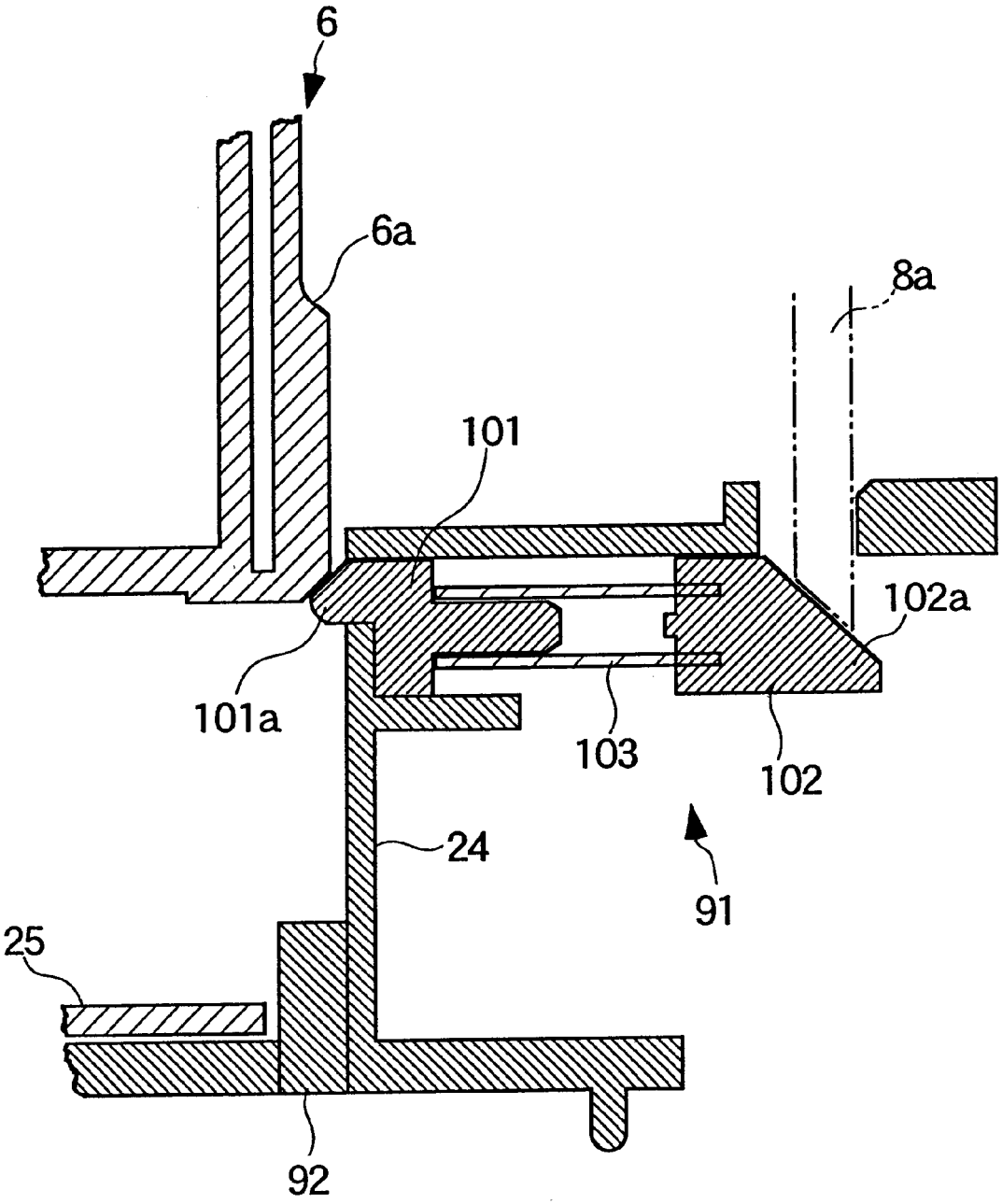
FIG. 10 is an enlarged sectional view of the holding nail and the component parts associated therewith, in a state of the tape cartridge being lifted.

In this case, the tape cartridge 6 has side surfaces thereof each formed with a sloped portion serving as an engaging portion 6*a,* and the forward ends 110*a* of the nail elements 101 press the respective engaging portions 6*a* of the tape cartridge 6 mounted in the compartment casing 24, whereby the tape cartridge 6 is sandwiched between the nail elements 101 and pressed down (see FIG. 9). Further, the forward end 101*a* of each of the nail elements 101 has an upper half thereof formed as a sloping surface. When the tape cartridge 6 is being loaded (lowered) in the compartment casing 24, each of the nail elements 101 is pressed by the tape cartridge 6 against the coiled spring 103 and once retracted into the compartment casing 24, thereby permitting the tape cartridge 6 to be mounted. Similarly, when the tape cartridge 6 is being lifted by the ejection mechanism 9, the nail element 101 is pressed by the tape cartridge 6 against the coiled spring 103 and once retracted into the compartment casing 24, thereby permitting the tape cartridge 6 to be removed. Then, when the ejection plate 25 is lowered after completing the lifting of the tape cartridge 6, the tape cartridge 6 is placed on the nail elements (forward The urging members 102 are also each attached to the compartment casing 24 such that they can advance and withdraw. A trailing end 102*a* of each urging member 102 has a sloping surface. When an operating piece 8*a* of the lid 8 is brought into abutment with the trailing end 102*a* from a perpendicular direction (from above), the urging member 102 is advanced against the coiled spring 103 by a component of the force received from the operating piece 8*a*. More specifically, in a state of the lid 8 being open, each of the urging members 102 is held in its standby position by a stopper, not shown, and presses on the nail element 101 with a small urging force by the coiled spring 103. When the lid 8 is closed from this state, the operating piece 8*a* causes the urging member 102 to advance to thereby press on the nail element 101 with a large force via the coiled spring 103.

This permits the tape cartridge 6 to be mounted or removed with a relatively small force, and immovably held by a relatively large force e.g. during printing operation. It should be noted that reference numeral 93 in FIG. 5 designates a positioning projection for positioning the tape cartridge 6. The tape cartridge 6 is seated on the seat projections 92 in a state positioned by the positioning projection 93.

Figure 8:
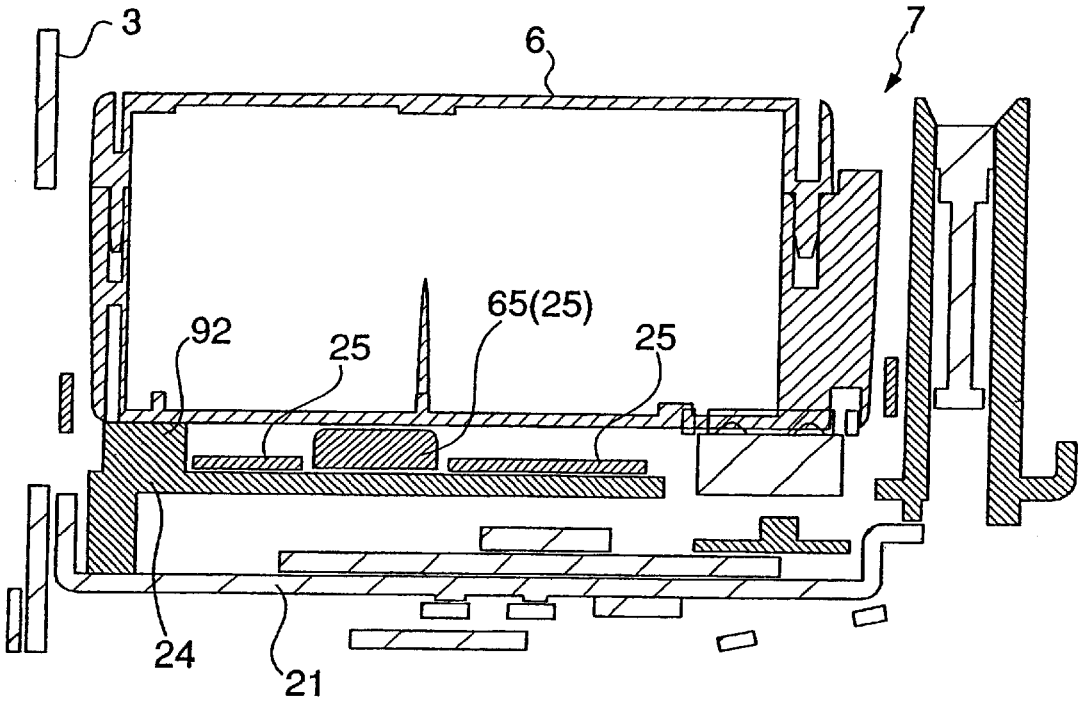
FIG. 8 is a cross-sectional view of a tape cartridge in a state mounted in the compartment casing (cartridge compartment)

FIG. 8 shows a state in which the tape cartridge 6 is loaded in the compartment casing 24, and the ejection plate 25 has been shifted to its standby position (standby state). The tape cartridge 6 is seated on the seat projections 92 in a state sandwiched by the pair of holding nails 91, 91, while the ejection plate 25 including the projections 65 is placed in its standby state at a position lower than the seat projections 92. That is, the ejection plate 25 is on standby below the tape cartridge 6 while maintaining a space between the tape cartridge 6 and the ejection plate 25 itself.

When the ejection plate 25 starts to be lifted from this state, the tape cartridge 6 is transferred from the seat projections 92 to the ejection plate 25, and continues to be lifted while causing the pair of holding nails 91, 91 to retract. When the ejection plate 25 reaches its uppermost position, the holding nails 91 are disengaged from the tape cartridge 6. Subsequently, when the ejection plate 25 starts to be lowered, the tape cartridge 6 is transferred from the ejection plate 25 to the projected holding nails 91 such that it is placed on the same. In the meantime, the ejection plate 25 continues to be lowered until it reaches its standby position. On the other hand, when the tape cartridge 6 is mounted, the ejection plate 25 is in its standby position (lowermost position), and the tape cartridge 6 is pushed inward against the urging force of the holding nails 91 to a position for abutment against the seat projections 92 of the compartment casing 25, and mounted thereat.

As described above, according to the present embodiment, since the tape cartridge 6 mounted in the cartridge compartment 7 is seated not on the ejection plate 25, but on the seat projections 91 of the cartridge casing 24, it is possible to hold the tape cartridge 6 in a stable state while maintaining its level orientation. As a result, the printing tape can be brought to the print head 14 and the platen 18 without being rolled out in an inclined state from the tape cartridge 6. Further, when the tape cartridge 6 is mounted, the ejection plate 25 is held in its standby position (lowermost position) lower than the location of the seat projections 91, which makes it possible to prevent the user from placing the tape cartridge 6 in a half mounted state.

It should be noted that although in the above embodiment, the ejection mechanism is driven by the motor, the present invention is applicable to an ejection mechanism driven by a spring or the like. Further, the number of the seat projections is not limited so long as a tape cartridge can be held in a stable state. Moreover, the ejection plate in its low standby position is only required to be positioned away from the tape cartridge, so that it is not necessary to set the standby position at a location below the seat projections (assuming that a tape cartridge has an underside surface which is not flat).

INDUSTRIAL APPLICABILITY

As described above, according to the tape printing apparatus of the invention, since a tape cartridge mounted in the cartridge compartment is seated not on the lift plate of the ejection mechanism, but on the seat portion of the cartridge compartment, it is possible to hold the tape cartridge in a stable and accurately positioned state for printing. That is, the cartridge-ejecting function implemented by the ejection mechanism and the cartridge-holding function by the cartridge compartment can be separately performed, which is suitable for preventing the ejection mechanism from adversely affecting printing operation.

What is claimed is:

1. A tape printing apparatus including a cartridge compartment for removably mounting a tape cartridge therein, and an ejection mechanism for lifting said tape cartridge mounted, from said cartridge compartment, characterized in that:

said cartridge compartment has a bottom thereof formed with a seat portion for seating thereon said tape cartridge in a mounted state, and a lift plate of said ejection mechanism having a standby state and an actuated state, said lift plate for lifting a tape cartridge is positioned away from said tape cartridge seated on said seat portion when said lift plate is in said standby state and is in a lifting state for lifting said tape cartridge when said lift plate is in said actuated state.

2. A tape printing apparatus according to claim 1, wherein said cartridge compartment has a support member arranged therein for holding said tape cartridge in a lifted state, and wherein said lift plate immediately returns to its standby state after having been lifted to transfer said tape cartridge to said support member.

3. A tape printing apparatus according to claim 2, wherein said support member also serves as a holding nail for immovably holding said tape cartridge.

4. A tape printing apparatus according to claim 1, 2, or 3, wherein said seat portion is formed by three seat members arranged separately from each other.

5. A tape printing apparatus according to claim 1, 2, or 3, wherein said ejection mechanism comprises a lift plate for lifting a tape cartridge, link means for causing translation of said lift plate such that said lift plate can lifted and lowered, and a motor for operating said link means.

6. A tape printing apparatus according to claim 1, wherein said ejection mechanism comprises a lift plate for lifting a tape cartridge, link means for causing translation of said lift plate such that said lift plate can be lifted and lowered, and a motor for operating said link means.

* * * * *